US006810708B2

(12) United States Patent
Stalzer

(10) Patent No.: US 6,810,708 B2
(45) Date of Patent: Nov. 2, 2004

(54) SHEET METAL BENDING MACHINE FOR FORMING CLEATS

(75) Inventor: Leo H. Stalzer, Union, MO (US)

(73) Assignee: Lion Machinery, Inc., Pacific, MO (US)

( * ) Notice: Subject to any disclaimer, the term of this patent is extended or adjusted under 35 U.S.C. 154(b) by 0 days.

(21) Appl. No.: 10/375,506

(22) Filed: Feb. 26, 2003

(65) Prior Publication Data

US 2003/0159491 A1 Aug. 28, 2003

Related U.S. Application Data

(60) Provisional application No. 60/359,857, filed on Feb. 27, 2002.

(51) Int. Cl.[7] ..... B21D 5/04
(52) U.S. Cl. ..... 72/319
(58) Field of Search ..... 72/319, 320, 388, 72/387

(56) References Cited

U.S. PATENT DOCUMENTS

| | | | | | |
|---|---|---|---|---|---|
| 312,547 | A | | 2/1885 | Andersen | |
| 1,030,259 | A | | 6/1912 | Wells | |
| 1,192,797 | A | * | 7/1916 | Salmon | 72/294 |
| 1,408,106 | A | * | 2/1922 | McCabe | 72/304 |
| 1,713,964 | A | | 5/1929 | Hoff et al. | |
| 1,744,391 | A | * | 1/1930 | Kuehn | 72/319 |
| 1,785,537 | A | | 12/1930 | Stevens | |
| 2,722,858 | A | | 11/1955 | Oyen | |
| 3,662,584 | A | * | 5/1972 | Jones et al. | 72/411 |
| 3,731,514 | A | | 5/1973 | Deibele, Jr. | |
| 3,786,666 | A | * | 1/1974 | York, Jr. | 72/305 |
| 3,815,393 | A | | 6/1974 | Daniels | |
| 3,875,784 | A | | 4/1975 | Daniels | |
| 3,946,588 | A | | 3/1976 | Mayston | |
| 3,948,074 | A | * | 4/1976 | Stalzer | 72/312 |
| 3,983,735 | A | | 10/1976 | Berry | |
| 4,014,200 | A | | 3/1977 | Wolters | |
| 4,185,487 | A | | 1/1980 | Merideth | |
| 4,242,898 | A | | 1/1981 | Salvagnini | |
| RE31,938 | E | * | 7/1985 | Klukow | 72/387 |
| 4,875,356 | A | * | 10/1989 | Boardman et al. | 72/321 |
| 5,497,643 | A | | 3/1996 | Koch et al. | |
| 5,802,906 | A | | 9/1998 | Lillbacka et al. | |
| 5,934,133 | A | | 8/1999 | Takahashi et al. | |
| 6,038,909 | A | | 3/2000 | Zink | |

FOREIGN PATENT DOCUMENTS

| | | |
|---|---|---|
| DE | 1452919 | 4/1971 |
| FR | 2686533 | 7/1993 |
| JP | 46785 | 12/1978 |
| NL | 8203340 | 3/1984 |

* cited by examiner

*Primary Examiner*—Daniel C. Crane
(74) *Attorney, Agent, or Firm*—Polster, Lieder, Woodruff & Lucchesi

(57) ABSTRACT

A centerless sheet metal bending machine is provided for forming cleats in sheet metal. The machine includes a housing having a table upon which a piece of sheet metal can be supported. The housing has a mouth through which the sheet metal can be extended and a gap between an end of the table and the mouth. The machine includes a clamping assembly for holding said sheet metal in place and a bending assembly for forming bends (cleats) in the sheet metal. The clamping assembly comprises a hold down bar and a table bar having a clamping surface. The table bar is link driven between an open position in which the clamping surface of the table bar is spaced from the hold down bar and a closed position in which the table bar clamping surface is positioned beneath the hold down bar. The bending assembly comprising a bending bar mounted on a gear segment which rides in a curved track. The gear segment defines an arch of less than 360° and the track defines a slot so that the machine, when in the start position, can accept sheet metal having a width greater than the width of the machine. To facilitate the bend, the bending bar bending surface defines an obtuse angle with the table bar clamping surface and a complimentary acute angle with the horizontal. The acute angle is preferably less than about 20°.

18 Claims, 5 Drawing Sheets

SHEET METAL BENDING MACHINE FOR FORMING CLEATS

CROSS-REFERENCE TO RELATED APPLICATIONS

This application claims priority to Provisional Application Ser. No. 60/359,857 filed Feb. 27, 2002, which is entitled "Sheet Metal Bending Machine", and which is incorporated herein by reference.

STATEMENT REGARDING FEDERALLY SPONSORED RESEARCH OR DEVELOPMENT

Not Applicable.

BACKGROUND OF THE INVENTION

This invention relates to sheet metal bending machines, and, in particular, to an open center or center-less sheet metal bending machine which forms a tear drop shape cleat, such as is used to connect sections of ductwork together to provide a tight fit for the drive cleats used in the ductwork.

Sheet metal bending machines generally have shafts which drive the element which bends the sheet metal. The use of such shafts prevents such bending machines from being used to bend sheet metal which has a length greater than the length of the opening of the sheet metal bending machine. Hence, the length of sheet metal which can be bent by such current machines is limited by the size of the opening into the machine.

SUMMARY OF THE INVENTION

Briefly stated, a center-less sheet metal bending machine is provided for forming cleats in sheet metal. The sheet metal bending machine comprises a housing having a table upon which a piece of sheet metal can be supported, a mouth through which said sheet metal can be extended, and a gap between an end of the table and the mouth. The mouth is open on its opposite ends so that the sheet metal having a width greater than the width of the bending machine can be inserted in the mouth. A clamping assembly holds the sheet metal in place. The clamping assembly comprises a stationary hold down bar, and a movable table bar having a clamping surface. The table bar is movable between an open position in which the table bar clamping surface is spaced from said hold down bar and a closed position in which said table bar clamping surface is positioned beneath said hold down bar. A table drive is provided to move the table bar between its open and closed positions. The table drive includes a link pivotally connected at a first end to an actuator and pivotally connected at a second end to the table bar, whereby, upon activation of the actuator, the link is pivoted thereby causing the table bar to move from its open position to its closed position.

In one embodiment, the actuator is a cylinder. The cylinder has a cylinder rod to which the link being pivotally connected. The cylinder rod is moved reciprocally, and, upon movement of the rod in a first direction, the table bar is moved from its open position to its closed position; and upon movement of the cylinder rod in a second, opposite direction, the table bar is moved from its closed position to its opened position.

In a second embodiment, the actuator is a cable. The link is pivotally mounted at its said first end to the housing; and the cable is connected to the link between the link's first and second ends. When the cable is pulled, the link is pivoted to move the table bar from its open position to its closed position. In this second embodiment, a spring mechanism is provided to return the table bar to its open first position from its second position.

The position of the table bar can be adjusted to enable different gauge sheet metal to be placed in the machine. The adjustment assembly includes a table bar support and an adjustment bar. The table bar support engages the underside of the table bar. The adjustment bar is pivotally mounted in the housing and oriented generally horizontally in the housing. The adjustment bar is pivotally connected to the table bar support at a point spaced from the pivot point of the adjustment bar. The angle of the adjustment bar can be altered, thereby raising or lowering the support bar, and hence, decreasing or increasing the space between the table bar clamping surface and the hold down bar.

The machine also includes a bending assembly for forming a bend in said sheet metal. The bending assembly comprising a bending bar mounted on a rotatable member to be moveable between a start position in which sheet metal can be inserted in said machine and a finished position. The bending bar has a bending surface which engages the sheet metal to bend the sheet metal as the bar is rotated. A bending bar drive rotates the rotatable member. The rotating member is a gear segment moveable on an arced track. The gear segment and track both have the same curvature, and have a common center point. The bending bar is mounted to the gear segment to extend radially into the curvature defined by the gear segment and track such that the end of the bending bar is approximately at the common center of the gear segment and track. The track is generally circular and forms an opening which is aligned with the mouth of the housing.

The gear segment, and hence the bending bar, is driven by a drive which includes a toothed member which operatively engages said gear segment to rotate said gear segment. The toothed member comprises a toothed rack which is reciprocally driven between a first position in which said bending bar is in its start position and a second position in which said bending bar is in its finished position by a cylinder. In one embodiment, the toothed rack directly drives the segment gear.

In a second embodiment, the toothed rack engages and drives a pinion gear, which in turn drives upper and lower idler gears. The upper and lower idler gears are positioned to engage said segment gear to rotate said segment gear, and hence said bending bar.

The bending bar bending surface defines an acute angle to the horizontal and an obtuse angle with said table bar clamping surface when said bending bar is in its starting position. When the clamp is moved to its closed position; an initial bend is formed in the sheet metal which corresponds to the angle of said bending surface. Preferably, the acute angle is less then 20°. Preferably, the angle is between about 5° and about 15°.

The machine also includes a control system. The control system is operable to activate the bending bar drive when the table bar is moved to its closed position; to activate said table drive to move said table from said closed position to its open position upon partial completion of said cleat; and to move said bending bar to said start position upon reaching said finished position.

BRIEF SUMMARY OF THE INVENTION

Briefly stated, a centerless sheet metal bending machine is provided for forming cleats in sheet metal. The machine includes a housing having a table upon which a piece of sheet metal can be supported. The housing has a mouth through which the sheet metal can be extended and a gap between an end of the table and the mouth. The machine includes a clamping assembly for holding said sheet metal in place and a bending assembly for forming bends (cleats) in the sheet metal.

The clamping assembly comprises a hold down bar and a table bar having a clamping surface. The table bar is movable between an open position in which the clamping surface of the table bar is spaced from the hold down bar and a closed position in which the table bar clamping surface is positioned beneath the hold down bar. A table drive moves the table bar between its open and closed positions. The table drive includes a link pivotally connected to an actuator and to the table bar, whereby, upon activation of the actuator, the link is pivoted thereby causing the table bar to move from its open position to its closed position.

In one embodiment, the actuator is a cylinder having a cylinder rod. The link is pivotally connected at a first end to the cylinder rod and at a second end to the table bar. Upon movement of the rod in a first direction, the table bar is moved from its open position to its closed position and upon movement of the cylinder rod in a second direction, the table bar is moved from its closed position to its opened position. In a second embodiment, the actuator is a cable. The link is pivotally mounted at a first end to the housing and pivotally connected at a second end to the table bar. The cable is connected to the link between the link's first and second ends. When said cable is pulled, the link is pivoted to move the table bar from its open position to its closed position.

The bending assembly comprising a bending bar mounted on a rotatable member. The bending bar has a bending surface which engages the sheet metal to bend the sheet metal. A bending bar drive rotates the rotatable member from a start position to a finished position to form a cleat in the sheet metal. When the table bar is in its closed position and the bending bar is in its start position, the bending bar bending surface defines an obtuse angle with the table bar clamping surface and a complimentary acute angle with the horizontal. The acute angle is preferably less than about 20°.

To enable the bending bar to rotate, the bending bar is fixed to a gear segment which is rotatably mounted in the housing. The gear segment preferably defines an arc of les than 360°, such that the gear segment will not block the sides of the housing mouth when the bending bar is in its start position. The drive includes a toothed member (preferably a piston or cylinder driven rack) which operatively engages the gear segment to rotate the gear segment. The toothed rack can directly drive the gear segment. Alternatively, the bending bar drive can include a pinion gear which is driven by the toothed rack and upper and lower idler gears driven by said pinion gear. The upper and lower idler gears are positioned to engage the segment gear to rotate the segment gear, and hence the bending bar.

The gear segment is rotatably mounted in a curved track. The curved track defines an opening which, when the bending bar is in its start position, is aligned with housing mouth. Thus, a piece of sheet metal greater in width than the width of the machine can be inserted into the machine. The gear segment and track both have the same curvature, and having a common center point. The bending bar is mounted to the gear segment to extend radially into the curvature defined by the gear segment and track such that the end of the bending bar is approximately at the common center of the gear segment and track. The track is generally circular and defines an opening which is aligned with the mouth of the housing so as to not block the sides of the mouth so that the machine can accept sheet metal having a width greater than the width of the machine.

A table bar adjuster is provided to adjust the position of the table bar clamping surface relative to the hold down bar when the table bar is in its closed position. The table bar adjuster includes a table bar support in engagement with a lower surface of the table bar and an adjustment bar pivotally connected to the table bar support at one end of the adjustment bar. The adjustment bar is pivotally mounted in the housing. When the adjustment bar is pivoted, it alters the vertical position of the table bar clamping surface relative to the hold down bar.

A control system is provided to activate the bending bar drive when the table is moved to its closed position, to activate said table drive to move the table from the closed position to its open position upon partial completion of the cleat; and to move the bending bar to the start position upon reaching the finished position.

BRIEF DESCRIPTION OF THE SEVERAL VIEWS OF THE DRAWINGS

Corresponding reference numerals will be used throughout the several figures of the drawings. For clarity, not all parts of the machine are shown in each drawing.

DETAILED DESCRIPTION OF THE INVENTION

Figure 1:
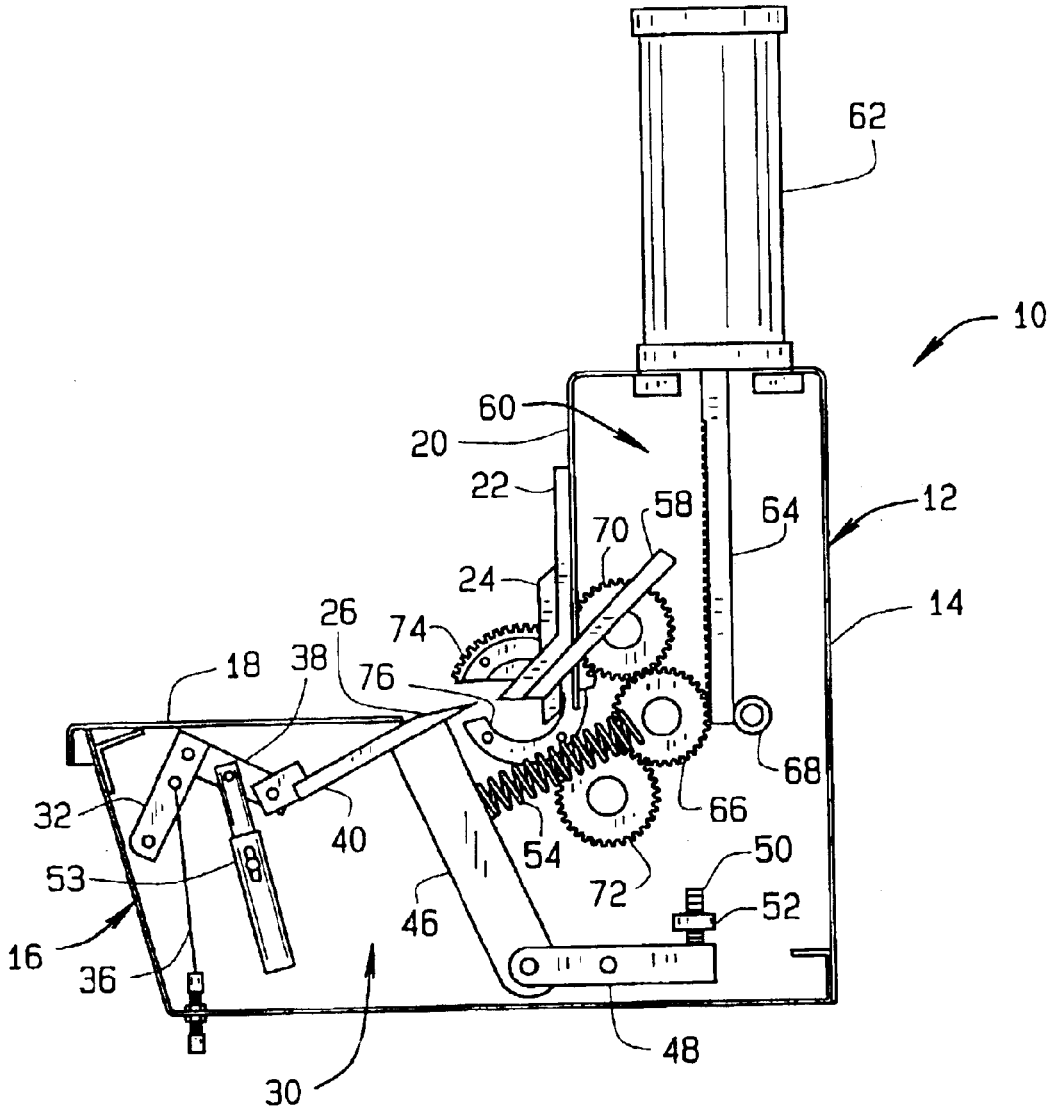
FIG. 1 is a cut-away view of a cleat bending machine of the present invention with the machine in a start or open position.

The following detailed description illustrates the invention by way of example and not by way of limitation. This description will clearly enable one skilled in the art to make and use the invention, and describes what I presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

A first illustrative example of machine 10 of the present invention for forming cleats in sheet metal is shown in FIGS.

1–4. The metal bending machine 10 and includes a housing 12 having a generally vertical portion 14 and a generally horizontal portion 16. Hence, the housing 12 is generally L-shaped in side elevation. The upper surface 18 of the generally horizontal portion forms a table upon which sheet metal M (FIG. 3) to be bent is placed and supported. The forward surface 20 of the generally vertical portion 12 includes a hold down bar 22 and gauge fingers 24. The bottom of the hold down bar 22 is spaced slightly above the table surface 18. This vertical spacing between the hold down bar 22 defines a mouth or opening 23 through which the sheet metal M is passed to be bent. The table surface 18 does not extend all the way to the hold down bar 22 or the gauge fingers 24. Rather, there is a gap 26 between the back edge of the table surface 18 and the hold down bar 22 and gauge fingers 24. The hold down bar 22 includes a generally vertical portion 22*a* (FIG. 3) which is mounted to the vertical portion surface 20 and a lower potion 22*b* which extends diagonally towards the table surface 18.

The gauge fingers 24 extend through slots (not shown) in the hold down bar 22 and have a length, such that the fingers 24 extend below the table surface 18 to limit the extent to which the sheet metal can be inserted into the opening. The gauge fingers 24 are preferably movable in a horizontal direction normal to the vertical portion 12, to vary the extent to which the sheet metal M can be inserted into the opening.

Figure 2A:
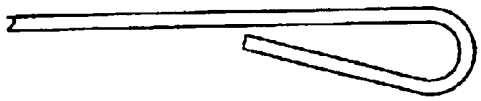
FIG. 2A is a end view showing the shape the sheet metal is bent to by the machine.
Figure 2:
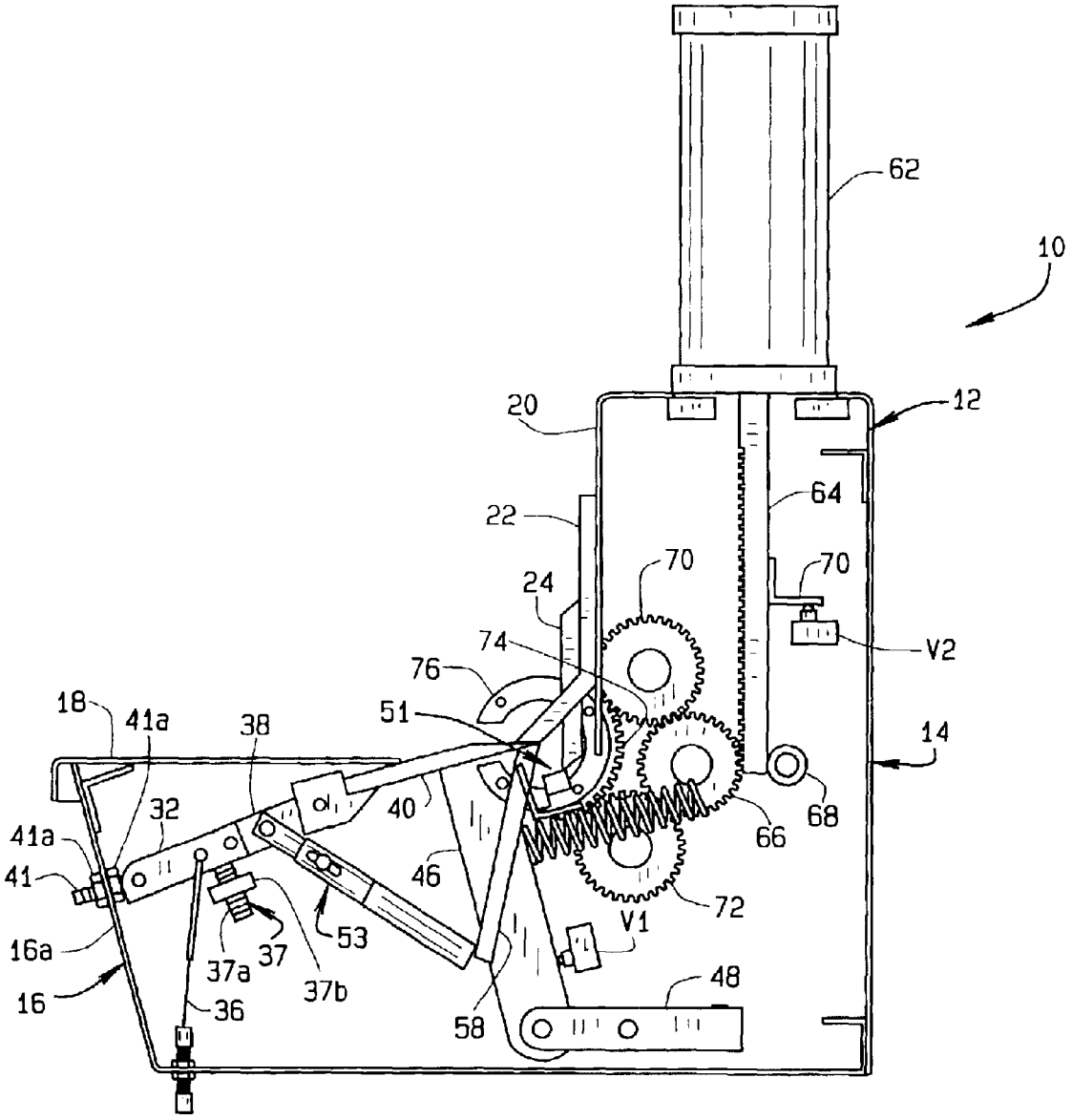
FIG. 2 is a view similar to FIG. 1, but showing the machine in a closed position when a bend is almost complete.

A metal clamping or grasping assembly 30 is housed in the housing horizontal portion 16. The clamping assembly 30 is shown in isolation in FIG. 3. The clamping assembly 30 includes a toggle 32 which is pivotally mounted to the housing 12 at its bottom end 32*c*. A foot pedal (not shown) is operatively connected to the toggle 32 by a cable 36. As seen, the cable 36 is connected to the toggle 32 at a point 32*b* which is between the toggle top end 32*a* and the toggle bottom end 32*c*. An arm 38 is pivotally connected to the toggle 32 at the top 32*a* of the toggle, and extends rearwardly from the toggle 32. As can be appreciated, because the cable 36 is connected to the toggle 32 above its pivot point 32*c*, when the foot pedal is depressed, and the cable is pulled, the toggle 32 and arm 38 will attain a generally straight configuration, as seen in FIG. 2.

An adjustable toggle stop 37 (FIG. 2) is mounted to the housing 12 in the path of movement of the toggle 32. The toggle stop includes a bolt 37*a* which passes through a nut 37*b* or other similar structure having a threaded hole. The toggle stop 37 is positioned such that the toggle 32 will contact the stop 37 when the toggle 32 and the arm 38 are preferably just past a straight line, or just over center, as seen in FIG. 2. By changing the position of the bolt 37*b*, the angle between the toggle 32 and the arm 38 when the toggle 32 contacts the stop 37 can be adjusted. Other equivalent structures could also be used to act as the toggle stop 37. An adjustable eye bolt 41 extends through the front surface 16*a* of the housing horizontal portion 16. A pin extends through the eye bolt to pivotally mount the toggle 32 in the housing 12. Adjusting the nuts 41*a* on the eye bolt 41 will adjust the horizontal position of the toggle 32 within the housing.

A table bar 40 is pivotally connected at its forward end 40*a* to the back end 38*a* of the arm 38. The table bar 40 is sized such that it extends into the gap 26 between the back end of the table surface 18 and the hold down bar 22. The back end of the table bar is sloped to that it comes to a pointed end, as at 40*b*.

Figure 3:
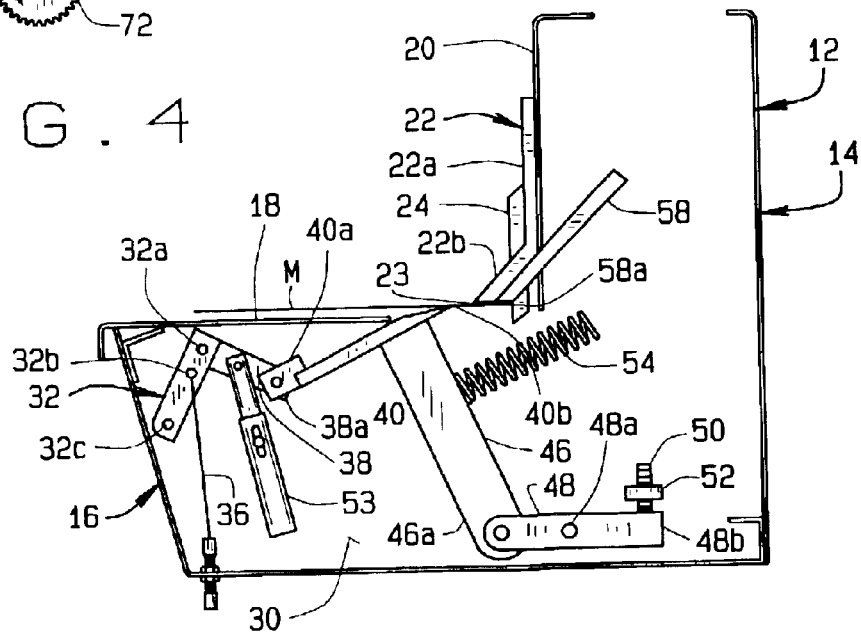
FIG. 3 is a cut-away view of the machine showing only the metal bending members of the machine in the open position.

The back or sloped end of the table bar 40 is urged upwardly into the gap 26 by a bar 46. The bar 46 is pivotally connected at its bottom end 46*a* to a link 48. The link 48 is pivotally mounted to the housing 12 between its ends, as at 48*a* (FIG. 3). The angle, or cant, of the link 48 is controlled by an adjusting screw 50. The adjusting screw 50 passes through a nut 52 (or equivalent structure having a threaded hole) and which is mounted to the housing 12. The screw 50 is also operatively connected to the back end 48*b* of the link 48. Hence, by rotating the screw, the back end of the link will be raised or lowered, and the forward end of the link will be lowered or raised. The screw 50 could also operate against a spring which would bias the back end 48*b* of the link 48 against the screw 50. A table stop 51 (FIG. 2) is positioned behind the bar 46 to limit the amount of travel of the bar 46, and hence, of the table bar 40. The table stop 51 is preferably adjustable, so that the end limit of travel of the table bar 40 can be adjusted. The table stop 51, for example, can be comprised of a bolt and nut, similarly to the toggle stop 37. Other equivalent structures could also be used.

A link release arm 53 is fixed to, and extends diagonally from, the link 38. The link release arm 53 preferably is made of two members which are adjustably connected together, to allow for adjustment of the overall length of the release arm. The link release arm can include first and second portions connected by a nut and bolt which extends through an elongate slot. The release arm can be made to be adjustable in length by other conventional means as well, which are known in the art.

In operation, when the foot pedal is depressed, the cable 36 pulls down on the toggle 32, which causes the arm 38 to raise up. The cable 36 is adjusted to have a length such that it moves the connection between the toggle 32 and the link 38 just over center. As the arm 38 raises up, the table bar 40 is moved rearwardly. In its most rearward position, the back end 40*b* of the table bar 40 is positioned beneath the bottom of the hold down bar lower section 22*b*, as seen in FIG. 2. In this position, the bar 46 pushes the back end of the table bar 40 upwardly, to clamp the sheet metal M between the table bar 40 and the hold down bar 22. As can be appreciated, by adjusting the screw 50, the space between the table bar 40 and the bottom of the hold down bar 22 can be adjusted, to enable the machine to accept sheet metal of different gauges.

A spring 54 is mounted at a back end to the housing 12. The forward end of the spring 54 bears against the back surface of the bar 46, and the spring 54 is compressed. When the table bar 40 is in its forward position, the elbow or junction between the toggle 32 and link 38 is bent to a position just over center, as noted above. In this position, the toggle and link are in a locked position, and the force of the spring against the bar 46 will not return the toggle and link to their start position (i.e., their position as shown in FIG. 1). The foot pedal is released after being completely depressed and bending begins. After the sheet metal has been bent, and the link and toggle are released, as described below, the spring 54 returns to its normal position and pushes the table bar 40 rearwardly, to unclamp the sheet metal M from the machine 10.

When the table bar 40 is moved to its rearward position, the sheet metal will be clamped in position, as noted above, with an edge of the sheet metal butting against the gauge fingers 24. An elongate bending bar 58 is caused to pivot, as described below, to bend the edge of the sheet metal into a teardrop shape, as seen in FIG. 2A. The bending bar extends across the width of the machine, to form a cleat having a length substantially equal to the width of the machine.

The power train 60 which drives the bending bar 58 is housed in the housing vertical section 14. The power train includes a cylinder 62 which is mounted to the top of the housing vertical section 14. The cylinder, which can be either pneumatic or hydraulic, drives a piston rod (not shown), as is known. A toothed rack 64 is fixed to the end of the piston rod, such that activation of the cylinder drives the rack in a reciprocal fashion. The rack 64 engages a pinion gear 66 to drive the gear 66 as shown by the arrow A when the rack 64 is moved downwardly. The rack 64 is held in engagement with the pinion gear 66 by a roller 68. The pinion gear 66, in turn, drives an upper idler gear 70 and a lower idler gear 72. The arrows B and C show the direction of rotation of the idler gears 70 and 72 as the rack is moved downwardly by the cylinder 60. The idler gears 70 and 72, in turn, drive a gear segment 74. The direction of rotation of the gear segment 74 when the rack is moved downwardly is shown by the arrow D. The bending bar 58 is mounted to the gear segment 74, as seen in FIG. 1. The gears 66, 70, and 72, and the roller 68 are all mounted to the housing 12 in any conventional manner.

Figure 4:
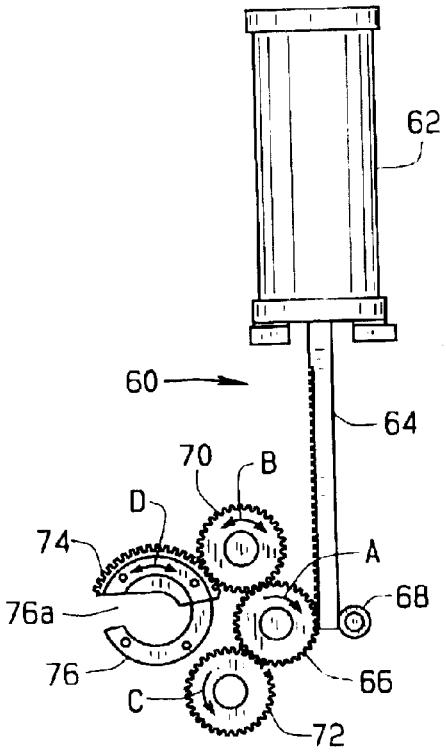
FIG. 4 is a cut-away view of the machine, showing only the power train of the machine in the open position, with arrows on the gears showing the direction of rotation of the gears during bending of sheet metal.

The gear segment 74 is mounted on a curved track 76 (FIG. 4), which in turn, is mounted to the housing 12. The back of the gear segment 74 is grooved, and the groove conforms to the shape of the track 76 so that the gear can slide around the track 76. Alternatively, the track 70 could be provided with a groove, and the gear segment could be provided with a curved rib which engages the groove in the track. The gear segment 74 and the track 76 both have the same curvature, and the circles defined by the gear segment 74 and the track 76 have a common center point. Preferably, the track 76 is made from bronze, and forms a bearing upon which the gear segment slides.

The bending bar 58 is mounted to the gear segment 74 to extend radially into curvature defined by the gear segment 74 and the track 76 such that the end of the bending bar 58 is at the common center of the gear segment 74 and track 76. Additionally, the bending bar 58 is positioned on the gear segment 74, such that when the rack 64 is in its raised position (as seen in FIG. 1), the bending bar 58 is parallel to, and in abutment with, the inner surface of the diagonal lower portion 22*b* of the hold down bar 22. The end of the bending bar 58 is beveled, as at 58*a*, so that the bottom surface of the bending bar 58 will be parallel to, and substantially co-planar with, the bottom surface of the hold down bar lower portion 22*b*, as seen in FIG. 2). Because the beveled tip of the bending bar 58 is at the center of the gear segment 74, as the gear segment 74 is moved along the track 76, the bending bar will pivot or rotate about its tip.

The track 76 is generally circular, with an opening 76*a* which is aligned with the mouth 23. Hence, the sheet metal M will extend into the mouth 23 and through the opening 76*a* to be positioned beneath the beveled end 58*a* of the bending bar.

In operation, the sheet metal is initially inserted into the mouth or opening 23 of the metal bending machine until it engages the gauge fingers 24. When the foot pedal is pressed, the table bar 40 will be moved forwardly and upwardly, as described above, to clamp the sheet metal M between the sloped end of the table bar and the bottom surface of the hold down bar. When the table bar reaches the end of its travel, the bar 46 contacts a pneumatic limit valve V1 (FIG. 2), which is in communication with a spool valve (not shown) to control the direction of hydraulic fluid to the cylinder 62 to control the direction of travel of the cylinder rod and the rack 64. In this case, the spool valve will be positioned, such that the cylinder will drive its piston rod, and hence the rack 64, downwardly. As the rack 64 moves downwardly, it drives the pinion gear 66, which in turn, drives both the upper and lower idler gears 70 and 72. The idler gears, in turn, drive the gear segment 74 to rotate the bending bar. As can be seen, as the bending bar 58 rotates about its forward end, it bends the sheet metal. The forward end 40*b* of the table bar 40 defines location of the bend of the sheet metal. Stated differently, the bending bar 58 bends the sheet metal about the forward end of the bending bar.

At the beginning of a cycle (i.e., in the start position), the gear segment 74 is initially only in meshing contact with the upper pinion gear 70. The segment gear 74 is only about 180° of arc. When the gear segment has moved about 90° of arc, the gear segment 74 disengages the upper idler gear 70 and engages the lower idler gear 72. The upper and lower idler gears are positioned relative to each other such that there is a short period when the gear segment 74 engages both idler gears, such that the upper idler gear can drive the gear segment 74 into engagement with the lower idler gear 72. When the segment gear 74 engages the lower idler gear 72, the sheet metal has been bent about 90°. As can be appreciated, the upper idler gear 70 drives the gear segment through an upper half of its rotation and the lower idler gear 72 drives the gear segment 74 through a lower half of its rotation. Thus, the two idler gears, in combination, will drive the gear segment 74 180° or more to complete bending of the sheet metal to form a cleat at the edge of the sheet metal.

When the bend in the sheet metal is mostly complete (i.e., when the bending bar as rotated about 160°) the bending bar 58 contacts the toggle bar release arm 53, and pushes the arm 53 forwardly and upwardly, as seen in FIG. 2. The movement of the toggle release arm 53 forces the toggle 32 and the link 38 to bend relative to each other, to release the toggle and link from their locked position, allowing the arm 38 to pivot relative to the toggle 32. As can be appreciated, the release arm 53 is adjusted to have a length sufficient to be contacted by the bending bar 58 such that the bending bar will be contacted and moved by the bending bar to release the toggle and link from their locked position.

When the toggle 22 and link 38 are released from their locked position, the arm 38 and the table bar 40 will pivot relative to each other under the force of the spring 54 (which was compressed by the forward movement of the table bar 40 and the bar 46); and the bar 46 will push the table bar 40 rearwardly. Thus, table bar 40 will be moved out of the way of the bending of the sheet metal, and the cylinder can continue to pivot the bending bar 58 to complete the bend in the sheet metal to obtain the configuration seen in FIG. 2A.

As the table bar 40 is being retracted, the bending bar, as noted, continues its rotation until the edge of the sheet metal has been completely turned. At the end of its travel, a finger 70 on the rack 64 contacts a second, or return, limit valve V2, which is in communication with the spool valve to change or reverse the direction of travel of the rack to return the bending bar 58 to its start position. Although the return valve V2 is positioned to be activated by the rack 64, the return switch could also be positioned to be activated by the bending bar 58, or by any of the gears 60, 70, or 72. The gears, like the rack, could be provided with a finger which activates the return switch. Alternatively, if the return switch is located at the bottom of the path of travel of the rack, the end of the rack could trip the return switch.

The arrangement of the track 76 and the gear segment 74 allows for the bending of a portion of the edge of the sheet metal M without distorting or disturbing the remainder of the edge of the sheet metal because the remainder of the sheet metal edge can extend through and beyond the track 76 and gear segment 74. The rotation of the bending bar 58 by way of the gears 66, 70, 72, and 74 enables rotation of the bending bar without having a shaft, making the metal bending machine an open center or center-less machine. Additionally, the use of the foot pedal for activation of the metal bending machine eliminates the need for a separate cylinder and valves to move the table bar 40.

Preferably, the machine 10 is sized to be placed on a table. Hence, the machine 10 is relatively compact in size. For example, the machine 10 is designed to be 37" wide, 25" deep, and 18" high (to the bottom of the cylinder 62). The cylinder 62 is 18" long, and hence, the machine 10, including the cylinder, is 36" tall. With these dimensions, the machine 10 can be positioned on a work bench. Alternatively, the machine 10 can be provided with legs so that it will be free standing.

Figure 5:
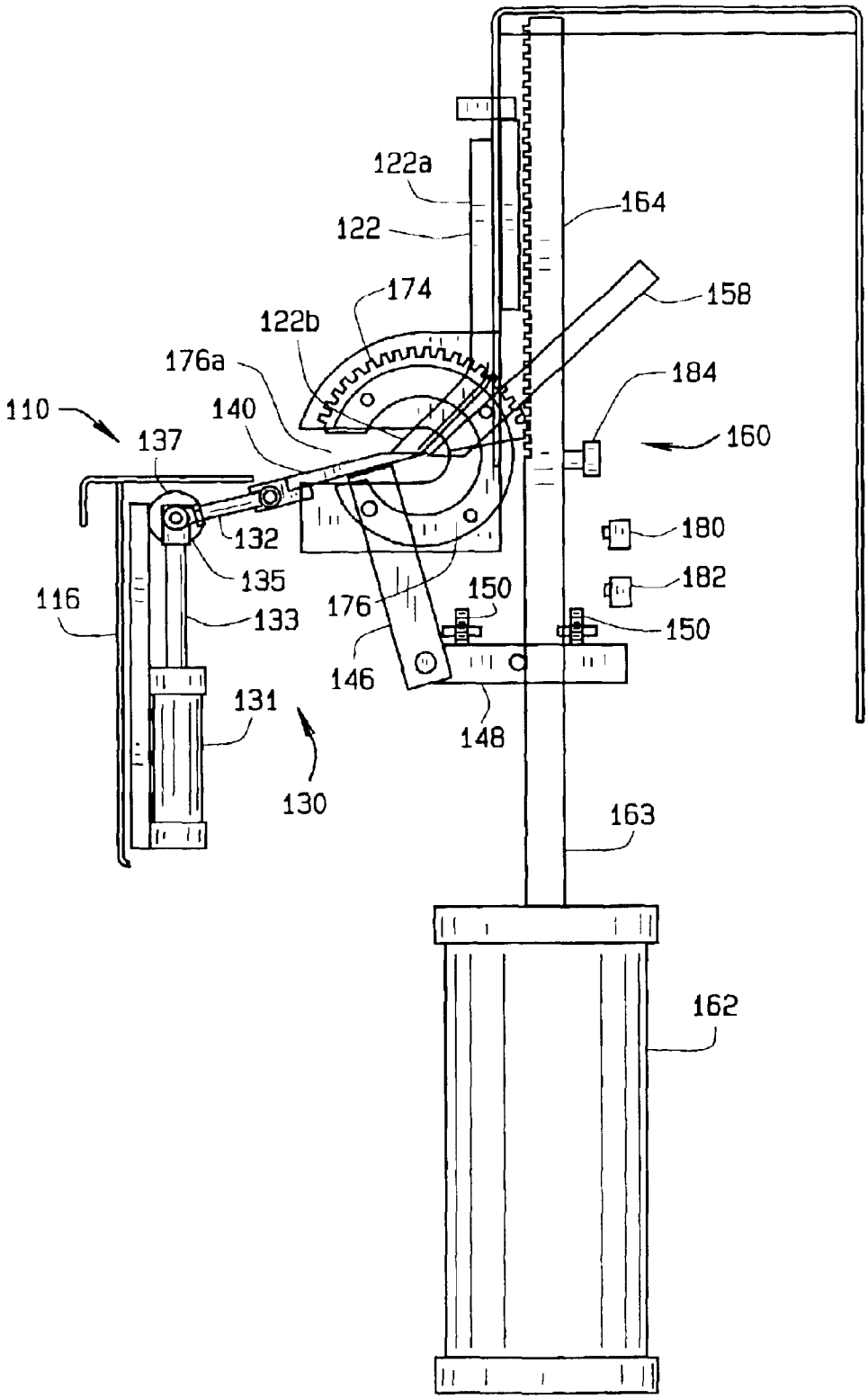
FIG. 5 is a schematic view of a second embodiment of the cleat bending machine of the present invention.
Figure 6:
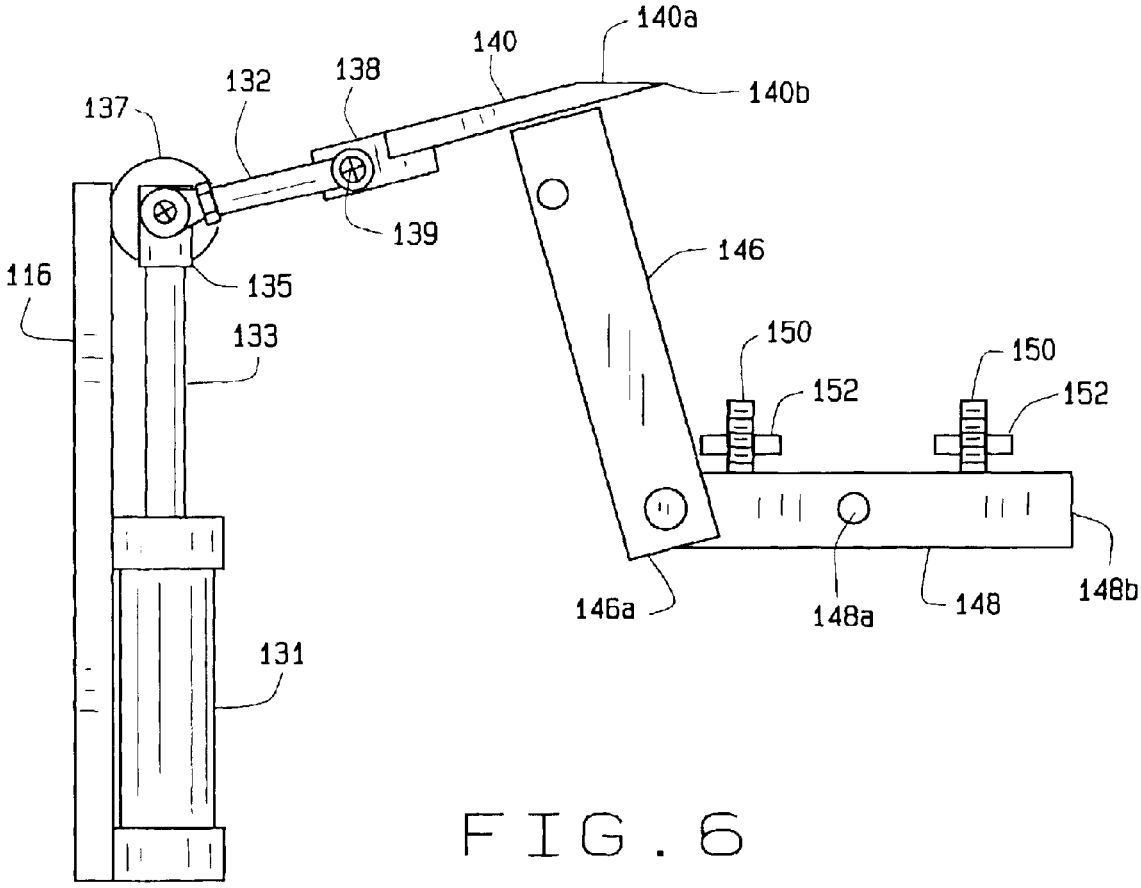
FIG. 6 is an enlarged schematic view of the table assembly of the cleat bending machine of FIG. 5.
Figure 7:
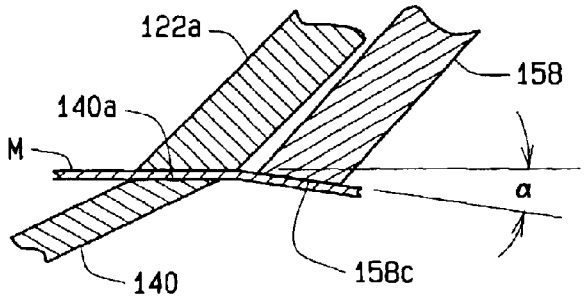
FIG. 7 is an enlarged view showing the relationship between the bending bar, the table, and the hold down bar of the bending bar of the machine of FIG. 5 with a piece of sheet metal in place to be bent.

A second embodiment 110 of the cleat bending machine is shown in FIGS. 5–7. The machine 110 includes a grasping assembly 130 for grasping the sheet metal during bending of the cleat and a power train 160 which bends the sheet metal to form the cleat, both of which are contained within the housing (shown only in part in FIG. 5). As with the machine 10, the machine 110 includes a generally vertical portion in which the power train 160 is contained and a generally horizontal portion in which the grasping assembly 130 is contained.

The machine 110 also includes a hold down bar 122 which is mounted to the outer surface of the vertical portion of the housing, above the mouth of the housing. The hold down bar has a generally vertical portion 122*a* which is mounted to a front surface of the housing and a lower, angled portion 122*b*. The lower portion 122*b* preferably forms an angle of about 45° with the upper vertical portion. The bottom or end edge of the hold down bar 122 is generally level. As will be described below, during a bending operation, the bottom edge of the hold down bar engages the sheet metal to hold it in place.

The grasping assembly 130 is shown in isolation if FIG. 6, and works in conjunction with the hold down bar to maintain a piece of sheet metal in place during a cleat forming or sheet metal bending cycle. The clamping assembly 130 is operated by a cylinder 131 (which can be a pneumatic or hydraulic cylinder) having a cylinder rod 133. The rod includes a clevis 135 at its end in which a roller 137 is rotatably mounted. The cylinder is positioned against the inner surface of the front wall 116 of the housing of the bending machine 110. A toggle or link 132 is pivotally mounted at one end to the clevis 135, and is pivotally mounted at a second end to a mounting block 138 at a pivot point 139. A table bar 140 is mounted to the mounting block 138. The end surface 140*a* of the table bar is sloped to that it comes to a pointed end, as at 140*b*.

The back or sloped end 140*a* of the table bar 140 is supported by a table support bar 146. The table support bar 46 is pivotally connected at its bottom end 146*a* to a height adjustment bar 148. The height adjustment bar 148 is pivotally mounted to the housing between its ends, as at 148*a* (FIG. 3). The angle, or cant, of the height adjustment bar 148 is controlled by a pair of adjusting screws 150, there being one adjusting screw on either side of the pivot point 148*a*. The adjusting screws 150 pass through nuts 152 (or equivalent structure having a threaded hole) which are mounted to the housing. The screws 150 are in operative contact with the upper surface of the height adjustment arm 148. Thus, by rotating the right screw (with reference to FIG. 6), the back end of height adjustment arm will be lowered, thereby raising the support 146 and hence the table bar 140. Conversely, when the left screw is rotated, the left end of the height adjustment arm 148 (with reference to FIG. 6) will be lowered, thereby lowering the support 146 and hence the table bar 140. The height of the table bar 140 could be adjusted using a single screw, as described above in conjunction with the bending machine 10 of FIG. 1. Additionally, one of the screws 150 could operate against a spring which would bias the back end 148*b* of the height adjustment rod 148 against the screw 150. Alternatively, the screws could be replaced with other devices which allow for the angle of the adjustment rod 148, and hence, the height of the support bar 146 and the table bar 140, to be altered. Such alternative adjustment mechanisms could include a rack and pinion arrangement, a hydraulic or pneumatic cylinder, or any other conventional mechanism which would be operable to pivot the adjustment bar about its pivot point.

As can be appreciated, the cylinder 131, rod 133, and link 132 comprise a drive which moves the table bar 140 between its open and closed positions. FIGS. 5 and 6 show the table 140 when extended (or in its closed position). In the open position, the cylinder rod 133 is retracted, and the link 132 and mounting block/table bar are pivoted relative to each other about the pivot point 139 to form a general "v" shape, similar to that shown in FIG. 1. In operation, when the cylinder 131 is activated (for example by a button on the housing), the cylinder rod 133 extends. As the rod 133 extends, the roller 137 rolls against the inner surface of the front wall 116 and the link 132 and the table bar 140 rotate relative to each other about the pivot point 139 to a position in which the two members 132 and 138/140 define a generally straight line. Actually, preferably, the two members pivot to a point that is slightly over center to lock the two members in place relative to each other. When the table bar 140 is extended, as shown if FIG. 5, the forward edge 140*a* of the table bar 140 is below the end edge of the hold down bar. In this position, the table bar forward edge is generally horizontal. As seen in FIG. 7, the sheet metal M is then clamped between the hold down bar 122 and the table bar 140. As can be appreciated, by adjusting the screws 150, the space between the table bar 140 and the bottom of the hold down bar 122 can be adjusted, to enable the machine to accept sheet metal of different gauges.

When the table bar 140 is moved to its rearward (or closed) position, the sheet metal will be clamped in position, as noted above, with an edge of the sheet metal butting against a stop, as described above in conjunction with the machine 10. As the table bar 140 is moved to its closed position, the table support bar 146 pivots about its lower pivot point. When the table bar 140 reaches its closed position, an elongate bending bar 158 is caused to pivot, as described below, to bend the edge of the sheet metal into a teardrop shape cleat, as seen in FIG. 2A. The bending bar 158 spans substantially the width of the machine to form a cleat having a length substantially equal to the width of the metal bending machine.

The power train 160 which drives the bending bar 158 is contained in the housing vertical section. The power train includes a cylinder 162 which is shown mounted in a bottom part of the machine (but which could be mounted in the top of the housing vertical section). The cylinder 162, which can be either pneumatic or hydraulic, drives a piston rod 163. A toothed rack 164 is fixed to the end of the piston rod, such that activation of the cylinder drives the rack in a reciprocal fashion. The rack 164 engages a gear segment 174. The bending bar 158 is mounted to the gear segment 174. The rack 164 can be held in place relative to the gear segment 174 using rollers, for example, as shown in FIG. 1, so that the rack does not deflect away from the gear segment.

The gear segment 174 is identical to the gear segment 74 of the machine 10. Briefly, the gear segment 174 is mounted on a curved track 176, which in turn, is mounted to the housing. The gear segment 174 and the track 176 both have the same curvature, and the circles defined by the gear segment 174 and the track 176 have a common center point. Preferably, the track 176 is made from bronze, and forms a bearing upon which the gear segment 174 slides.

The bending bar 158 is mounted to the gear segment 174 to extend radially into curvature defined by the gear segment 174 and the track 176 such that the end of the bending bar 158 is at the common center of the gear segment 174 and track 176. Additionally, the bending bar 158 is positioned on the gear segment 174, such that when the rack 164 is in its raised position (as seen in FIG. 5), the bending bar 158 is parallel to, and in abutment with, the inner surface of the diagonal lower portion 122*b* of the hold down bar 122. The end of the bending bar 158 is beveled. Because the beveled tip of the bending bar 58 is at the center of the gear segment 74, as the gear segment 74 is moved along the track 76, the bending bar will pivot or rotate about its tip.

The beveled bottom surface 158*a* of the bending bar 158 forms an obtuse with the end surface 140*a* of the table bar 140 (and a complementary acute angle with the horizontal), such that the bending bar surface 158*a* drops below the level of the table bar surface 140*a*. This is shown in an exaggerated form in FIG. 7, where the bending bar surface 158*a* forms an acute angle of $\alpha$ with the horizontal. The angle $\alpha$ is less than 20°. Preferably, the angle is between about 5° and 15°, and I have found that an angle of about 7° works well.

The track 176 is generally circular, with an opening 176*a* which is aligned with the mouth of the bending machine. Hence, the sheet metal M will extend into the mouth and through the opening 176*a* to be positioned beneath the beveled end 158*a* of the bending bar. When the table bar 140 is moved to its closed position to clamp the sheet metal M in place between the table bar 140 and the hold down bar 122, an initial bend is formed in the sheet metal which is equal to the angle $\alpha$. Hence, the sheet metal is partially bent before the bending bar 158 is pivoted.

In operation, the sheet metal is initially inserted into the mouth or opening of the metal bending machine until it engages a stop. When the table cylinder 131 is activated, the table bar 140 is moved forwardly and upwardly, as described above, to clamp the sheet metal M between the sloped end of the table bar and the bottom surface of the hold down bar. As noted above, the clamping action also forms an initial bend in the sheet metal. When the table bar reaches the end of its travel, the bar 146 contacts a pneumatic limit valve, such as the valve V1 in FIG. 2, which is in communication with a spool valve (not shown) to control the direction of hydraulic fluid to the cylinder 162 to control the direction of travel of the cylinder rod and the rack 164. In this case, the spool valve will be positioned, such that the cylinder will drive its piston rod, and hence the rack 164, downwardly. As the rack 164 moves downwardly, gear segment 174 to rotate the bending bar. As can be seen, as the bending bar 158 rotates about its forward end, it bends the sheet metal. The forward end 140*b* of the table bar 140 defines location of the bend of the sheet metal. Stated differently, the bending bar 158 bends the sheet metal about the forward end of the bending bar.

The bending machine 110 includes two switches in the vertical portion—a table retract switch 180 and a bending reverse switch 182. The switches 180 and 182 are activated by a switch trip arm 184 on either the rack 164 of the piston rod 163. When the bend in the sheet metal is mostly complete (i.e., when the bending bar as rotated about 160°) the trip arm 184 engages the table retract switch 180. Switch 180 activates a limit valve to cause the table cylinder 131 to retract its cylinder rod 133. As the cylinder rod 133 retracts, the link 132 is pulled downwardly, causing the link 132 and table bar 140 to pivot relative to each other about their pivot point 139. This will cause the table bar 140 to move to its open position, in which, as seen in FIG. 1, the forward edge of the table bar is spaced from the hold down bar.

As the table bar 140 is being retracted, the bending bar, as noted, continues its rotation until the edge of the sheet metal has been completely turned. At the end of its travel, the trip arm 184 contacts the switch 182 to activate a second, or return, limit valve, which is in communication with the bending cylinder 162 to reverses the direction of travel of the cylinder arm 163 and rack 164 to return the bending bar 158 to its start position.

Although the switches 180 and 182 are activated by an arm on the rack 164 or rod 163, the return switches could also be positioned to be activated by the bending bar 158, or by the gear segment 174. The gear segment or the bending bar, could be provided with a finger which activates the return switches. Alternatively, if the return switch is located at the bottom of the path of travel of the rack, the end of the rack could trip the return switch.

As can be appreciated, the major difference between the power drive 160 of machine 110 and the power drive 60 of the machine 10, is that the additional gears were eliminated, such that the rack 164 directly drives the gear segment 174. It has been determined that with the initial bend formed in the sheet metal M by the table bar 140, the rack 164 can exert sufficient force to directly drive the gear segment 174 to complete the cleat bend. Additionally, because an initial bend is formed in the sheet metal, the gear segment can be rotated less than 180°.

As various changes could be made in the above constructions without departing from the scope of the invention, it is intended that all matter contained in the above description or shown in the accompanying drawings shall be interpreted as illustrative and not in a limiting sense. The rack 64 could be moved by means other than a cylinder. For example, the rack 64 could be driven by a motor. The valves V1 and V2 would then be replaced with switches which would reverse the rotation of the motor when activated. The spool valve(s), which control(s) the direction hydraulic fluid through the cylinder(s) can be controlled using other means. For example, limit valves can be replaced with a solenoid(s) or other electronic control(s) to alter the position of the spool valve(s). Additionally, the direction flow of hydraulic fluid through the cylinder(s) can be controlled or reversed using means other than pneumatic limit valves and spool valve(s). The link release arm could be connected to the bending bar, rather than the link. Other means could be used to release the toggle and link from their locked position. For example, a solenoid operated pin, or a valve, could be used to push the toggle/link junction back over center when the bender has bent the sheet metal, or even after the bender has returned to its start position. These examples are merely illustrative.

I claim:

1. A sheet metal bending machine comprising:

a housing having a table upon which a piece of sheet metal can be supported, a mouth through which said sheet metal can be extended, and a gap between an end of said table and said mouth;

a clamping assembly for holding said sheet metal in place; said clamping assembly comprising a hold down bar, a table bar having a clamping surface, said table bar being movable between an open position in which said clamping surface of said table bar is spaced from said hold down bar and a closed position in which said table bar clamping surface is positioned beneath said hold down bar, and a table drive for moving said table bar between its said open and closed positions, said table drive including a link pivotally connected to an actuator and to said table bar, whereby, upon activation of said actuator, said link is pivoted thereby causing said table bar to move from its open position to its closed position;

a bending assembly for forming a bend in said sheet metal: said bending assembly comprising a bending bar mounted on a rotatable member, said bending bar having a bending surface which engages said sheet metal to bend said sheet metal; and a bending bar drive for rotating said rotatable member from a start position to a finished position to form a cleat in said sheet metal; and a control system: said control system operable to activate said bending bar drive when said table bar is moved to its closed position, to activate said table drive to move said table bar from said closed position to its open position upon partial completion of said cleat; and to move said bending bar to said start position upon reaching said finished position;

said actuator comprising a cable; said link being pivotally mounted at a first end to said housing and pivotally connected at a second end to said table bar; said cable being connected to said link between said link first and second ends, whereby, when said cable is pulled, said link is pivoted to move said table bar from its open position to its closed position.

2. The machine of claim 1 wherein said table bar is in said closed position and said bending bar is in its said start position; said bending bar bending surface defines an obtuse angle with said table bar clamping surface and a complimentary acute angle with the horizontal.

3. The machine of claim 2 wherein said acute angle is less than 20°.

4. The machine of claim 1 wherein said actuator is a cylinder, said cylinder having a cylinder rod; said link being pivotally connected at a first end to said cylinder rod and at a second end to said table bar; whereby, upon movement of said rod in a first direction, said table bar is moved from its open position to its closed position and upon movement of said cylinder rod in a second direction, said table bar is moved from its closed position to its opened position.

5. The machine of claim 1 wherein said bending bar is fixed to a gear segment; said gear segment being rotatably mounted in said housing; said drive including a toothed member which operatively engages said gear segment to rotate said gear segment.

6. The machine of claim 5 wherein said toothed member comprises a toothed rack, said toothed rack being reciprocally driven between a first position in which said bending bar is in its start position and a second position in which said bending bar is in its finished position.

7. The machine of claim 6 wherein said toothed rack directly drives said gear segment.

8. The machine of claim 6 wherein said machine includes a pinion gear which is driven by said toothed rack; and upper and lower idler gears driven by said pinion gear; said upper and lower idler gears being positioned to engage said segment gear to rotate said segment gear, and hence said bending bar.

9. The machine of claim 5 wherein said gear segment is rotatably mounted in a curved track.

10. The machine of claim 9 wherein the gear segment and the curved track define an opening, which, when the bending bar is in its start position, is aligned with housing mouth.

11. The machine of claim 1 including a table bar adjuster operable to adjust the position of the table bar clamping surface relative to the hold down bar when said table bar is in its closed position.

12. The machine of claim 11 wherein said table bar adjuster includes a table bar support in engagement with a lower surface of said table bar and an adjustment bar pivotally connected to said table bar support at one end of said adjustment bar; said adjustment bar being pivotally mounted in said housing; whereby, pivoting of said adjustment bar alters the vertical position of said table bar clamping surface relative to said hold down bar.

13. A sheet metal bending machine; the machine comprising:

a housing having a mouth through which a piece of sheet metal can be inserted to form a bend in the sheet metal; said mouth being opened at its opposite ends;

a clamp moveable between an open position in which sheet metal can be inserted into and removed from said machine and a closed position in which the sheet metal is held in place in the machine; said clamp comprising a hold down bar fixed to said housing and a table bar having a clamping surface; said table bar being movable by a table bar drive between a first open position in which sheet metal can be inserted into and removed from said machine and a closed position in which said table bar clamping surface is beneath said hold down bar to clamp said sheet metal between said table bar clamping surface and said hold down bar;

said table bar drive comprising a link pivotally mounted in said housing and pivotally connected to said table bar, whereby pivotal movement of said link moves said table bar between its first and second positions;

a rotatable bending bar which engages said sheet metal to form a bend in said sheet metal;

a power train for driving said bending bar; and a first actuator, said first actuator being a cable; said link being pivotally mounted at a first end to said housing and pivotally mounted to said table bar at a second end; said cable being connected to said link between said link first and second ends, whereby, when said cable is pulled, said link is pivoted to move said table bar from its open position to its closed position.

14. The machine of claim 13 wherein said power train comprises a gear member mounted in said housing to rotate within said housing; and a drive operatively connected to said gear member to rotate said gear member, said bending bar being mounted to said gear member; said gear member defining an arc of less than 360°.

15. The machine of of claim 14 wherein said gear member is a gear segment; said power train further including an arced track on which said gear segment travels; said gear segment and track both have the same curvature, and having a common center point; said bending bar being mounted to said gear segment to extend radially into the curvature defined by the gear segment and track such that the end of the bending bar is approximately at the common center of the gear segment and track.

16. The machine of claim 15 wherein the track is generally circular; said track defining an opening which is aligned with the mouth of the housing.

17. The machine of claim 15 wherein said bending bar includes a bending surface which engages the sheet metal during a bending cycle; said bending bar bending surface being formed to define an acute angle with the horizontal and a complimentary obtuse angle with said clamp when said bending bar is in a starting position; whereby, when said clamp is moved to its closed position an initial bend is formed in said sheet metal which corresponds to the angle of said bending surface.

18. The machine of claim 13 including a second actuator; said second actuator being a cylinder; said cylinder having a cylinder rod; said link being pivotally connected at a said first end to said cylinder rod; whereby, upon movement of said rod in a first direction, said table bar is moved from its open position to its closed position and upon movement of said cylinder rod in a second direction, said table bar is moved from its closed position to its opened position.

* * * * *